United States Patent [19]

Medica et al.

[11] 4,217,380

[45] Aug. 12, 1980

[54] PROCESS FOR PRODUCING A RAISED EMBOSSED EFFECT

[75] Inventors: Joseph J. Medica; William T. Hahn, both of St. Petersburg, Fla.

[73] Assignee: The Celotex Corporation, Tampa, Fla.

[21] Appl. No.: 945,083

[22] Filed: Sep. 22, 1978

Related U.S. Application Data

[63] Continuation of Ser. No. 802,865, Jun. 2, 1977, abandoned.

[51] Int. Cl.[2] ..... B05D 5/00; B05D 1/28

[52] U.S. Cl. ..... 427/287; 101/170; 427/256; 427/288; 428/207

[58] Field of Search ..... 427/278, 258, 288, 256, 427/261, 287; 118/212; 428/195, 207; 101/170

[56] References Cited

U.S. PATENT DOCUMENTS

| | | | |
|---|---|---|---|
| 637,578 | 11/1899 | Hett | 101/148 |
| 778,665 | 12/1904 | Horton | 101/213 |
| 1,028,296 | 6/1912 | Sohier | 101/170 |
| 1,515,603 | 11/1924 | McAllaster | 427/197 |
| 1,600,487 | 9/1926 | Roehlen | 101/25 |
| 1,643,145 | 9/1927 | Winkler | 101/153 |
| 1,890,922 | 12/1932 | Waller | 101/152 |
| 1,892,392 | 12/1932 | Grupe | 101/211 |
| 1,907,771 | 5/1933 | Fellner | 101/170 |
| 2,132,086 | 10/1938 | Scheffler | 101/175 |
| 2,147,651 | 2/1939 | Jones et al. | 101/170 |
| 2,164,270 | 6/1939 | George | 101/153 |
| 2,247,540 | 7/1941 | Yanes | 101/170 |
| 2,275,062 | 3/1942 | Lathey | 101/170 |
| 2,338,558 | 1/1944 | Wickwire, Jr. | 101/401.2 |
| 2,375,660 | 5/1945 | Jones | 101/170 |
| 2,614,493 | 10/1952 | Brodie | 101/426 |
| 2,711,132 | 6/1955 | Viscardi | 101/170 |
| 2,937,955 | 5/1960 | Loomer | 427/288 X |
| 3,036,927 | 5/1962 | Jerothe | 427/272 |
| 3,109,368 | 11/1963 | Luttrell | 101/376 |
| 3,213,787 | 10/1965 | Miller | 101/211 |
| 3,304,861 | 2/1967 | Magid | 101/152 |

OTHER PUBLICATIONS

Hawley, G. G., *The Condensed Chemical Dictionary,* 8th Ed., 1971, New York, Van Nostrand Reinhold Co., p. 595.

Booth, G. L., *Coating Equipment and Processes,* 1970, New York, Lockwood Publishing Co., Inc., pp. 1,2,6.

*Primary Examiner*—Evan K. Lawrence

*Attorney, Agent, or Firm*—James W. Grace; Charles W. Vanecek

[57] ABSTRACT

A process for producing a raised embossed effect on a substrate comprising contacting the substrate with a pattern roll having depressions therein. The depressions are filled with a coating composition comprising a filler, a binder for the filler, water, and montmorillonite. The coating composition is transferred to the substrate in an embossed pattern while retaining the shape of the coating composition. Water is then removed from the coating composition.

36 Claims, 1 Drawing Figure

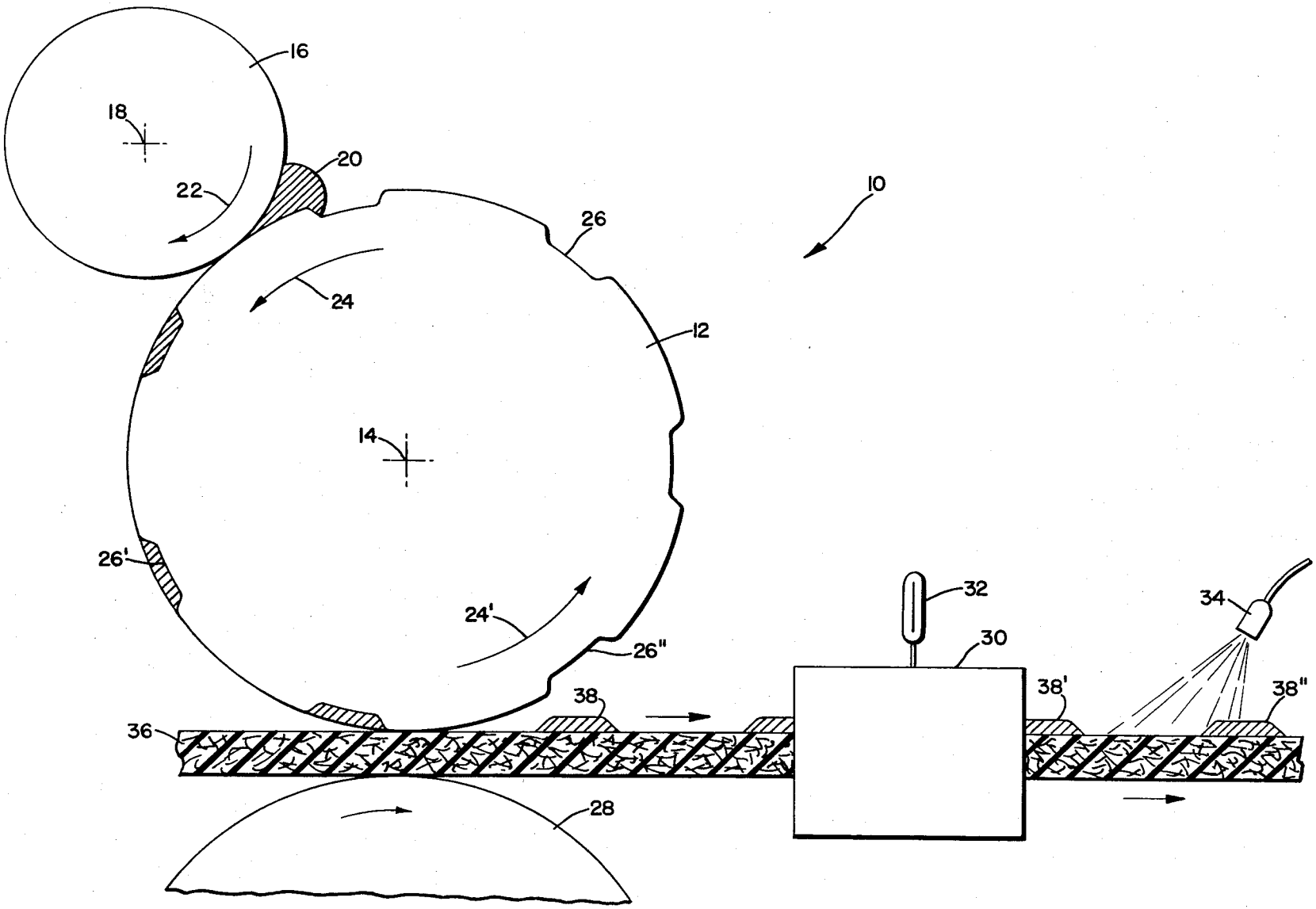
10
12
14
16
18
20
22
24
24'
26
26'
26"
28
30
32
34
36
38
38'
38"

PROCESS FOR PRODUCING A RAISED EMBOSSED EFFECT

This application is filed under the provisions of 37 CFR 1.60 and is a continuation of copending application Ser. No. 802,865 filed on 6/2/77, abandoned.

BACKGROUND OF THE INVENTION

A wide variety of processes have been employed in the past to produce a raised embossed effect on substrates in general and fiber board ceiling panels in particular. One such prior method includes pressing a textured roll or plate onto the surface of the substrate. Another prior method includes cutting, abrading, or routing out a portion of the surface of the substrate, thus creating a pattern. Yet another prior method includes application of a pattern from a printing press employing an adhesive ink followed by building up the pattern with solid material which is attached to the inked portion. Still another prior process includes the use of a chemical ink which resists cutting action followed by abrading of the surface. In an additional prior process a template having a pattern therein is placed over the surface. Those portions of the substrate not shielded by the template are then cut or abraded away.

The above prior methods suffer from a number of disadvantages. In general, the substrate is weakened because of the portion of the substrate material removed. Another disadvantage is that cutting, routing, and abrading creates dust. The dust creates an explosion hazard and is hazardous to workers. In order to ameliorate these hazards it is necessary to install and maintain complicated and expensive dust collection systems. Furthermore, when adhesive links are employed the material attached to the ink is flammable and difficult to handle.

Accordingly, it is an object of the present invention to provide an improved process for producing a raised embossed effect which is substantially free of one or more of the disadvantages of prior processes.

Another object is to provide an improved process which does not weaken the substrate.

Yet another object is to provide an improved process which does not require cutting, routing, or abrading.

Still another object is to provide an improved process which does not require the use of adhesive inks, chemical inks, or templates.

Additional objects and advantages of the present invention will be apparent to those skilled in the art by reference to the following detailed description and drawing which is a schematic representation to no scale of an apparatus suitable for practicing the process of the present invention.

SUMMARY OF THE INVENTION

According to the present invention, there is provided an improved process for producing a raised embossed effect on a substrate comprising the steps of:

I. contacting the substrate with a pattern roll having depressions therein which are filled with a coating composition comprising:
   A. a filler,
   B. a binder for the filler,
   C. water,
   D. montmorillonite which is finely divided, thereby transferring the coating composition to the substrate while retaining the shape of the coating composition, and then II. removing the water from the coating composition.

BRIEF DESCRIPTION OF THE DRAWING

The FIGURE shows a side view of an apparatus suitable for practicing the process of the present invention.

DESCRIPTION OF THE PREFERRED EMBODIMENTS

Referring now to the drawing, the apparatus 10 comprises a rubber pattern roll 12 rotatable about an axis 14. Adjacent to the pattern roll 12 is a doctor roll 16 having an axis 18 parallel to the axis 14. A bank 20 of coating composition is held in the nip between the pattern roll 12 and the doctor roll 16. The doctor roll 16 rotates in the direction of the arrow 22 whereas the pattern roll 12 rotates in the direction of the arrows 24, 24'. The pattern roll 12 is provided with depressions 26, 26', 26''. A support roll 28 is juxtaposed to the pattern roll 12. The apparatus 10 further comprises an oven 30 provided with a thermometer 32, and a spray nozzle 34.

In operation, the pattern roll 12 is caused to rotate in the direction of the arrows 24, 24', and the doctor roll 16 is caused to rotate in the direction of the arrow 22 preferably at an equal peripheral speed. The coating composition is added to the nip between the rolls 12, 16 to create the bank 20. As the depression 26 passes the bank 20 the depression 26 becomes filled with coating composition, as is the depression 26'. The substrate 36 which is preferably the fiber board ceiling panel is passed through the nip between the pattern roll 12 and the support roll 28. The pattern roll 12 is pressed toward the support roll 28 exerting a slight pressure such that the coating composition in the depression 26' leaves the depression 26' and is deposited on the substrate 36 in the form of a raised portion 38, 38', 38''. The substrate 36 then passes into the oven 30 where water is removed from the coating composition. When the substrate 36 leaves the oven 30, the raised portion 38' is only slightly reduced in size. If desired, a coating composition can be sprayed on the substrate 36 and the raised portion 38' by means of the nozzle 34.

It should be noted that the drawing is to no scale and that in an actual embodiment the pattern roll 12 has a diameter of only 19 cm. whereas the oven 30 is many times larger than the pattern roll 12. The substrate 36 can have a widely varying thickness but is commonly one-half inch thick (1.25 cm.). The substrate 36 can be any planar construction panel such as a low density or a high density fiber board, a gypsum wall board, or a siding product. The upper surface of the substrate 36 can be of any material such as paper, aluminum, steel, felt or asbestos.

A wide variety of fillers can be employed in the present invention. The preferred fillers are those which are inorganic, and are finely divided, having a particle size generally less than 200 microns and preferably less than 100 microns. Examples of suitable fillers include among others calcium carbonate, talc, silica, mica, china clay, calcined clay, and calcium metasilicate.

In the broadest aspects of the present invention, any binder can be employed that is compatible with the filler. However, the preferred binders are polymers of vinyl monomers such as vinyl acetate, vinyl chloride, methyl methacrylate, styrene, butadiene, and other vinyl monomers copolymerizable therewith. One preferred subclass of polymers are copolymers of styrene and butadiene. Another preferred class of polymers are those of methyl methacrylate either along or in combination with other vinyl monomers copolymerizable therewith. The binder is employed in an amount sufficient to bind the particles of the filler together and to adhere the filler to the substrate and is generally present in a weight ratio of filler to binder of 2:1 to 10:1. At much lower ratios, there is insufficient binder to bind the filler. Higher ratios are possible but are economically undesirable because the filler is less expensive than the binder.

Water is an essential ingredient of the coating composition and is present in an amount to provide the coating composition with the desired viscosity which is generally from 2,000 to 10,000 and preferably from 4,000 to 8,000 centipoises measured at 25° C. The ratio of filler to water is generally 1:1 to 5:1.

The coating composition can optionally contain additional ingredients such as pigments, fungicides, wetting agents, freezing point depressants, and/or defoamers. Examples of suitable pigments include, among others, titanium dioxide, red iron oxide, burnt umber, siennas, phthalocyanine green, phthalocyanine blue, and phthalocyanine red. Examples of suitable freezing point depressants include, among others, ethylene glycol, diethylene glycol, propylene glycol and hexylene glycol.

Montmorillonite is an essential component of the coating composition and is present in an amount sufficient to impart the desired thixotropic properties to the coating composition. The montmorillonite generally comprises from 2 to 20 and preferably comprises from 5 to 15 grams per liter based upon the volume of the coating composition. At much lower ratios, the raised portions 38, 38' will not maintain their form when present on the substrate 36. At much higher ratios, excessive pressure between the pattern roll 12 and the support roll 28 is required in order to transfer the coating composition from the depression 26' to the substrate 36. Furthermore, deformation of the raised portion 38' occurs.

The removing of the water can be effected by any convenient means such as air drying under ambient conditions, however the removing of the water is preferably accomplished by heating. The heating is effected for a time and at a temperature necessary to remove the water from the raised portion 38 and generally from 100 to 300 preferably from 180° to 240° C. At lower temperatures, an excessively long time is required for drying, whereas at higher temperatures, some thermal degradation of the binder or the substrate may occur.

EXAMPLE 1

This example illustrates the synthesis of a coating composition useful in the present invention.

The following quantities of the following ingredients are combined as indicated.

| Item | Ingredient | Quantity (grams) |
|---|---|---|
| A | Filler - calcium carbonate and silica in a weight ratio of 1:9 | 4540 |
| B | Polyvinylacetate latex | 700 |
| C | Water | 1500 |
| D | Montmorillonite | 25 |
| E | Wetting agent | 15 |
| F | Defoamer | 10 |

-continued

| Item | Ingredient | Quantity (grams) |
|---|---|---|
| G | Fungicide | 5 |

Items A through G are mixed under high shear.

The wetting agent is sodium hexametaphosphate. The defoamer is that available from the Drew Chemical Company under the tradename L-475. The fungicide is that available from the Dow Chemical Company under the tradename "Dowicide G".

The polyvinylacetate latex is available from the Union Carbide Company under the tradename "UCAR WC-131". This product is a homopolymer of vinyl acetate mixed with a dibutyl phthalate as a plasticizer. It is an oil-in-water emulsion at 60% solids and weighs 9.1 pounds per gallon.

The resultant composition is termed Composition A.

EXAMPLES 2 and 3

These examples illustrate the synthesis of coating compositions of the present invention employing various fillers.

The procedure of Example 1 was repeated except that the filler was replaced by an equal weight of talc, and the resultant composition termed Composition B.

The procedure of Example 1 is repeated except that the filler is replaced by an equal weight of mica, and the resultant composition termed Composition C.

EXAMPLES 4–6

These examples illustrate the synthesis of coating compositions of the present invention employing different binders.

The procedure of Example 1 is repeated except that the polyvinyl acetate latex is replaced with an equal weight of styrene-butadiene copolymer and the resultant composition termed Composition D; and then with an equal weight of a polymethylmethacrylate latex and the resultant composition termed Composition E; and finally with an equal weight of a copolymer of methylmethacrylate and vinyl acetate and the resulting composition termed Composition F.

EXAMPLE 7

This example illustrates the process of the present invention.

Referring to the FIGURE, a substrate 36 which is a one-half inch thick bagasse fiber board is passed under a portion roll 12, the bank 20 of which is sequentially filled with Compositions A through F, and then passed through an oven 30 maintained at 210° C. The resultant ceiling panels have a pleasing raised embossed effect corresponding to the depressions 26, 26', 26'' on the pattern roll 12.

What is claimed is:

1. A process for producing a raised embossed effect on a substrate comprising the steps of:

I. contacting the substrate with a pattern roll having depressions therein which are filled with a coating composition comprising:

A. a filler,

B. a binder for the filler,

C. water, and

D. montmorillonite which is finely divided in an amount necessary to impart the desired thixotropic properties to the coating composition, thereby transferring the coating composition in an embossed pattern to the substrate while retaining the shape of the coating composition, and then, II. removing the water from the coating composition.

2. The process of claim 1 wherein the substrate is a planar construction panel.

3. The process of claim 2 wherein the upper surface of the substrate is a member selected from the group consisting of paper, aluminum, steel, felt, and asbestos.

4. The process of claim 2 wherein the planar construction panel is a member selected from the group consisting of a fiber board, a gypsum wall board and a siding product.

5. The process of claim 2 wherein the substrate is a fiber board.

6. The process of claim 1 wherein the filler is a finely divided inorganic material.

7. The process of claim 6 wherein the filler has a particle size generally less than 200 microns.

8. The process of claim 6 wherein the filler has a particle size generally less than 100 microns.

9. The process of claim 1 wherein the filler is a member selected from the group consisting of calcium carbonate, talc, silica, mica, china clay, calcined clay, calcium metasilicate, and mixtures thereof.

10. The process of claim 1 wherein the filler is finely divided and is a member selected from the group consisting of calcium carbonate, talc, silica, mica, and mixtures thereof.

11. The process of claim 1 wherein the binder is a polymer of vinyl monomers.

12. The process of claim 11 wherein the binder is a polymer of a member selected from the group consisting of vinyl acetate, vinyl chloride, methyl methacrylate, styrene, butadiene and other vinyl monomers copolymerizable therewith.

13. The process of claim 11 wherein the binder is a polyvinyl acetate latex.

14. The process of claim 11 wherein the binder is a copolymer of styrene and butadiene.

15. The process of claim 11 wherein the binder is a polymer of methyl methacrylate.

16. The process of claim 11 wherein the binder is a copolymer of methyl methacrylate and a vinyl monomer copolymerizable therewith.

17. The process of claim 1 wherein the substrate is a fiber board panel and the filler is a member selected from the group consisting of calcium carbonate, talc, silica, mica, and mixtures thereof.

18. The process of claim 1 wherein the substrate is a fiber board panel, the filler is a member selected from the group consisting of calcium carbonate, talc, silica, mica, and mixtures thereof, and the montmorillonite comprises from 5 to 15 grams per liter based upon the total volume of the coating composition.

19. The process of claim 1 wherein the coating composition additionally contains pigments, fungicides, wetting agents, freezing point depressants, and/or defoamers.

20. The process of claim 1 wherein the weight ratio of A:B is 2:1 to 10:1.

21. The process of claim 1 wherein the weight ratio of A:C is 1:1 to 5:1.

22. The process of claim 1 wherein the water is present in an amount to provide the coating composition with a viscosity of from 2,000 to 10,000 centipoises measured at 25° C.

23. The process of claim 1 wherein the water is present in an amount to provide the coating composition with a viscosity of from 4,000 to 8,000 centipoises measured at 25° C.

24. The process of claim 1 wherein the montmorillonite comprises from 2 to 20 grams per liter based upon the total volume of the coating composition.

25. The process of claim 1 wherein the montmorillonite comprises from 5 to 15 grams per liter based upon the total volume of the coating composition.

26. The process of claim 1 comprising the steps of:

I. contacting under pressure the substrate with a pattern roll having depressions therein which are filled with a coating composition comprising:

A. a finely divided inorganic filler,

B. a binder for the filler,

C. water, and

D. finely divided montmorillonite, wherein the montmorillonite comprises from 2 to 20 grams per liter based upon the total volume of the coating composition, thereby transferring the coating composition in an embossed pattern to the substrate while retaining the shape of the coating composition, and then II. removing the water from the coating composition.

27. The process of claim 26 wherein the substrate is a fiber board panel and the filler is a member selected from the group consisting of calcium carbonate, talc, silica, mica, and mixtures thereof.

28. The process of claim 27 wherein the binder is a polymer of vinyl monomers.

29. The process of claim 26 comprising the steps of:

I. contacting under pressure the substrate with a pattern roll having depressions therein which are filled with a coating composition comprising:

A. a filler selected from the group consisting of calcium carbonate, talc, silica, mica, china clay, calcined clay, calcium metasilicate, and mixtures thereof, B. a binder comprising a polymer of vinyl monomers selected from the group consisting of vinyl acetate, vinyl chloride, methyl methacrylate, styrene, butadiene, and other vinyl monomers copolymerizable therewith, C. water, and D. finely divided montmorillonite wherein the montmorillonite comprises from 5 to 15 grams per liter based upon the total volume of the coating composition, thereby transferring the coating composition in an embossed pattern to the substrate while retaining the shape of the coating composition, and then II. removing the water from the coating composition.

30. The process of claim 26 comprising the steps of:

I. contacting under pressure a planar construction panel selected from the group consisting of a fiber board, a gypsum wall board and a siding product with a pattern roll having depressions therein which are filled with a coating composition comprising:

A. a filler selected from the group consisting of calcium carbonate, talc, silica, mica, china clay, calcined clay, calcium metasilicate, and mixtures thereof, B. a binder comprising a polymer of vinyl monomers selected from the group consisting of vinyl acetate, vinyl chloride, methyl methacrylate, styrene, butadiene, and other vinyl monomers copolymerizable therewith, C. water, and D. finely divided montmorillonite, wherein
the weight ratio of A:B is 2:1 to 10:1,
the weight ratio of A:C is 1:1 to 5:1, and
the montmorillonite comprises from 5 to 15 grams per liter based upon the total volume of the coating composition, thereby transferring the coating composition in an embossed pattern to the panel while retaining the shape of the coating composition, and then II. removing the water from the coating composition.

31. The process of claim 30 wherein the planar construction panel is a fiber board.

32. A process for producing a raised embossed effect on a fiber board ceiling panel comprising in sequence the steps of:

I. contacting under pressure the panel with a cylindrical rubber pattern roll having depressions therein of substantially equal depth when measured from the surface of the pattern roll, the depth being generally less than 1 cm wherein the depressions are completely filled with a coating composition comprising:

A. a finely divided particulate filler selected from the group consisting of calcium carbonate, talc, silica, and mica, B. a binder for the filler, said binder being an aqueous latex of a polymer of a monomer selected from the group consisting of vinyl acetate, vinyl chloride, methyl methacrylate, styrene, butadiene, and other vinyl monomers copolymerizable therewith, C. water, and D. montmorillonite having a particle size less than 50 microns,
wherein the weight ratio of A:B is 2:1 to 10:1,
wherein the weight ratio of A:C is 1:1 to 5:1,
wherein the montmorillonite comprises 5 to 15 grams per liter based on the total volume of the coating composition in an embossed pattern, thereby transferring the coating composition to the substrate while retaining the shape of the coating composition to produce a coated panel, and then, II. heating the coated panel to 180° to 240° C. to remove the water from the coating composition creating a raised embossed effect on the panel corresponding to the depressions in the pattern roll.

33. A process for producing a raised embossed effect on a fiber board panel comprising the steps of:

I. contacting under pressure the panel with a pattern roll having depressions therein which are filled with a coating composition comprising:

A. a finely divided filler selected from the group consisting of calcium carbonate, talc, silica, mica, and mixtures thereof, B. a polymeric binder selected from the group consisting of poly(vinyl acetate), styrene-butadiene copolymer, poly(methyl methacrylate), and a copolymer of methyl methacrylate and vinyl acetate, C. water, and D. finely divided montmorillonite, wherein
the weight ratio of A:B is 2:1 to 10:1,
the weight ratio of A:C is 1:1 to 5:1, and
the montmorillonite comprises 5 to 15 grams per liter based on the total volume of the coating composition, thereby transferring the coating composition in an embossed pattern to the panel while retaining the shape of the coating composition, and then II. removing the water from the coating composition.

34. The process of claim 33 wherein the coating composition additionally contains a wetting agent, defoamer and fungicide.

35. The process of claim 33 comprising the steps of:

I. contacting under pressure the panel with a rubber pattern roll having depressions therein which are filled with a coating composition comprising:

A. a finely divided filler selected from the group consisting of (a) a mixture of calcium carbonate and silica in a weight ratio of 1:9, (b) talc and (c) mica,

B. a polymeric binder selected from the group consisting of poly(vinyl acetate) styrene-butadiene copolymer, poly(methyl methacrylate), and a copolymer of methyl methacrylate and vinyl acetate, C. water, and D. finely divided montomorillonite, wherein
the weight ratio of A:B is 6.5:1,
the weight ratio of A:C is 3:1, and
the weight ratio of A:D is 182:1, thereby transferring the coating composition in an embossed pattern to the panel while retaining the shape of the coating composition, and then II. removing the water from the coating composition.

36. The process of claim 35 wherein the coating composition additionally contains a wetting agent, defoamer and fungicide.

* * * * *